US007524158B2

(12) United States Patent
Eckstein et al.

(10) Patent No.: US 7,524,158 B2
(45) Date of Patent: Apr. 28, 2009

(54) ADAPTER FOR MOUNTING SKID-STEER LOADER ATTACHMENTS ONTO AN EXCAVATOR ARM

(76) Inventors: Patrick J. Eckstein, 10115 Old Hickory Rd., Brookville, IN (US) 47012; Duane J. Werner, 27156 Valley Vista Dr. West, West Harrison, IN (US) 47060

( * ) Notice: Subject to any disclaimer, the term of this patent is extended or adjusted under 35 U.S.C. 154(b) by 235 days.

(21) Appl. No.: 11/454,400

(22) Filed: Jun. 16, 2006

(65) Prior Publication Data

US 2007/0031234 A1 Feb. 8, 2007

Related U.S. Application Data

(60) Provisional application No. 60/692,360, filed on Jun. 21, 2005.

(51) Int. Cl.
*E02F 3/00* (2006.01)

(52) U.S. Cl. ..... 414/723; 37/468

(58) Field of Classification Search ..... 414/723; 37/468; 403/324, 325

See application file for complete search history.

(56) References Cited

U.S. PATENT DOCUMENTS

| | | | | |
|---|---|---|---|---|
| 3,672,521 | A * | 6/1972 | Bauer et al. | 414/723 |
| 5,974,706 | A | 11/1999 | Kaczmarski et al. | |
| 6,000,154 | A | 12/1999 | Berard et al. | |
| 6,088,939 | A | 7/2000 | Logan | |
| 6,499,934 | B1 | 12/2002 | Kaczmarski et al. | |
| 6,606,805 | B2 | 8/2003 | Kimble et al. | |
| 6,619,906 | B2 * | 9/2003 | Dick | 414/723 |
| 6,939,099 | B1 * | 9/2005 | Stokkeland | 414/729 |

* cited by examiner

*Primary Examiner*—Donald Underwood
(74) *Attorney, Agent, or Firm*—James Ray & Assoc

(57) ABSTRACT

An adapter for mounting at least one skid-steer loader attachment onto an excavator arm includes a mounting mechanism having a lower edge, an upper edge and a lip extending outwardly therefrom, the lip receiving an upper lip of such at least one skid-steer loader attachment for locking thereto. The mounting member is adapted with a pair of aligned first notches, a pair of aligned second notches and a pair of apertures for coupling onto a free end of such excavator arm in a conventional semi-permanent manner. A pair of locking assemblies are provided selectively engaging and releasing a lower edge of such at least one skid-steer loader attachment.

12 Claims, 4 Drawing Sheets

ADAPTER FOR MOUNTING SKID-STEER LOADER ATTACHMENTS ONTO AN EXCAVATOR ARM

CROSS-REFERENCE TO RELATED APPLICATIONS

This application is related to and claims priority from Provisional Patent Application Ser. No. 60/692,360 filed Jun. 21, 2005.

FIELD OF THE INVENTION

The present invention relates, in general, to material handling and earth moving equipment and, more particularly, this invention relates to an adapter for mounting skid-steer loader attachments onto an excavator arm.

BACKGROUND OF THE INVENTION

As is generally well known in the art, skid-steer loaders and excavators, particularly known as mini excavators, use attachments to perform various material handling and earth moving tasks. Presently, the attachments used on the skid-steer loaders cannot be interchanged with the attachments used on mini excavators due to different mounting requirements. Therefore, users must often transport both types of equipment to work sites where the mini excavator in combination with attachments presently used for skid-steer loaders would be required. Or, users are forced to purchase two sets of attachments for a particular task when they would like to transport only the mini excavator.

SUMMARY OF THE INVENTION

The present invention provides an adapter for mounting at least one skid-steer loader attachment onto an excavator arm. The adapter includes a mounting member that has a lower edge, an upper edge and a lip extending outwardly therefrom. The lip receives an upper lip of such at least one skid-steer loader attachment to be locked thereto. A coupling means is provided for coupling the mounting member onto a free end of such excavator arm in a semi-permanent manner. A locking means is coupled to the mounting member and is operable for selectively engaging and releasing a lower edge of such at least one skid-steer loader attachment.

OBJECTS OF THE INVENTION

It is, therefore, one of the primary objects of the present invention to provide an adapter for mounting skid-steer loader attachments onto an excavator arm.

Another object of the present invention is to provide an adapter which securely mounts skid-steer loader attachments onto an excavator arm.

Yet another object of the present invention is to provide an adapter for mounting skid-steer loader attachments onto an excavator arm which does not require modifications to existing skid-steer loader attachments and existing excavator arms.

A further object of the present invention is to provide an adapter for mounting skid-steer loader attachments onto an excavator arm which enables the use of existing procedures for mounting attachments onto the excavator arm.

Yet a further object of the present invention is to provide an adapter for mounting skid-steer loader attachments onto an excavator arm which is simple and economical to manufacture.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
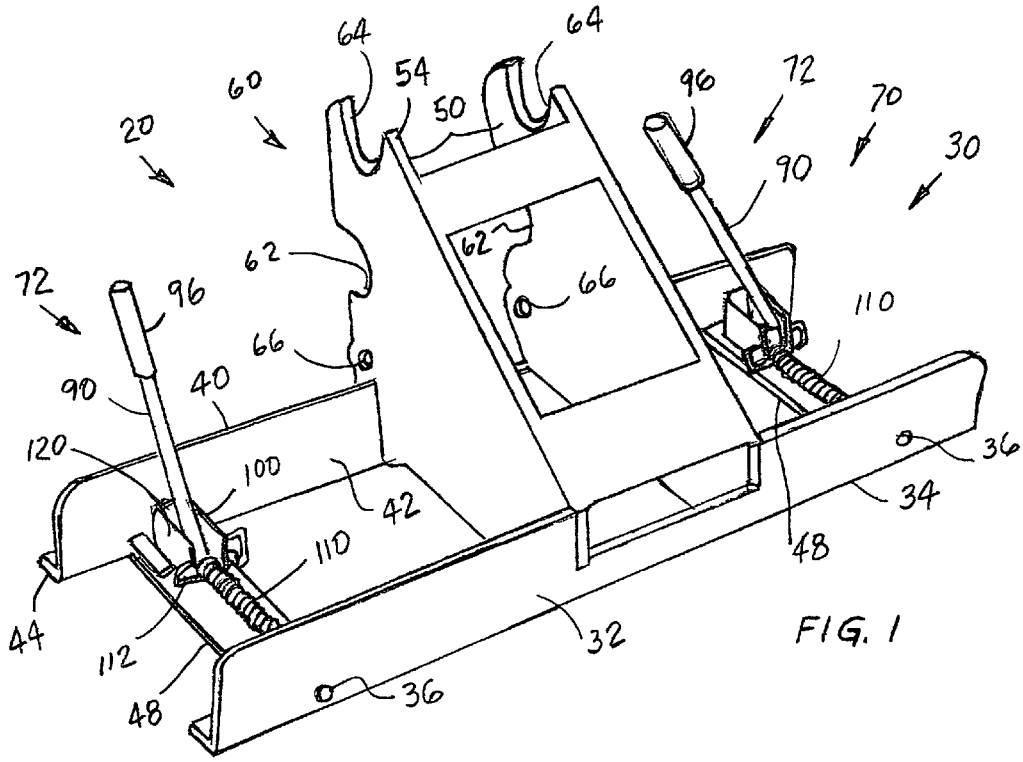
FIG. 1 is a perspective view of an adapter of the present invention for mounting skid-steer loader attachments onto an excavator arm.

Prior to proceeding to the more detailed description of the present invention, it should be noted that, for the sake of clarity and understanding, identical components which have identical functions have been identified with identical reference numerals throughout the several views illustrated in the drawing figures.

Reference is now made, to FIGS. 1-7, illustrated therein is an adapter, generally designated 20, for mounting at least one skid-steer loader attachment 2 to an excavator arm 10. The adapter 20 includes a mounting means, generally designated 30, which has a lower edge 34, an upper edge 42 and a lip 44 extending outwardly from the upper edge 42. In use, the lip 44 receives an upper generally V-shaped lip 4 of such at least one skid-steer loader attachment 2 to be locked thereto.

In the presently preferred embodiment of the invention, mounting means 30 includes a first generally L-shaped cross member 32 forming the lower edge 34. A second generally L-shaped cross member 40 forms the upper edge 42 and the lip 44 extends outwardly therefrom. A pair plate like members 50 are rigidly attached in a parallel spaced relationship with each other to the first cross member 32 and second cross member 40.

The first and second generally L-shaped cross members, 32 and 40 respectively, are spaced with each other at a predetermined distance. Furthermore, the plate like members 50 extend perpendicular to a rear surface of such skid-steer loader attachment 2. The presently preferred material of the mounting means 30 is steel.

The adapter 20 further includes a coupling means, generally designated 60, for coupling mounting means 30, in a semi-permanent manner, to a free end of excavator arm 10. The coupling means 60 includes a first pair of aligned generally U-shaped notches 62 each formed in a top edge 52 of a respective one of the plate like members 50 for engagement with a first pair of stationary pin lock members 12 extending outwardly from such excavator arm 10.

There is a second pair of aligned generally U-shaped notches 64 each formed in a rear edge 54 of the respective one of the plate like members 50 for engagement with a second pair of stationary pin lock members 14 extending outwardly from such excavator arm 10. A pair of aligned apertures 66 is provided, wherein each aperture 66 is formed adjacent a top edge 52 of the respective one of the plate like members 50 for receiving a removable locking pin 16 presently employed for retaining attachments to such excavator arm 10.

To securely retain the at least one skid-steer loader attachment 2, the adapter 20 further includes a locking means, generally designated 70, coupled to mounting means 30 and operable for selectively engaging and releasing a lower edge 6 of such at least one skid-steer loader attachment 2.

In the presently preferred embodiment of the invention, best shown in FIGS. 1-4, such locking means 70 includes a pair of manually operable locking assemblies, generally designated 72, which are mounted in a spaced relationship adjacent side edges of mounting means 30. Each locking assembly 72 includes an elongated hollow guide member 74 rigidly attached to the mounting means 30 adjacent the lower edge 34 thereof. A longitudinal axis of the guide member 74 is disposed perpendicular to the lower edge 34. Furthermore, a hollow interior portion 76 of the guide member 74 is aligned with an aperture 36 disposed within the lower edge 34.

An elongated locking member 80 is mounted for a sliding movement within the hollow interior portion 76 of the guide member 74. The locking member 80 has a first end 82 which is movable away from the lower edge 34 of the mounting means 30 into a latched position for engagement with a predetermined portion, such as an aperture 8, of such lower edge 6 of such at least one skid-steer loader attachment 2. The first end 82 is further movable towards the lower edge 34 into an unlatched position for releasing such lower edge 6 of such at least one skid-steer loader attachment 2.

A lever 90 has a first end 92 thereof connected to the mounting means 30 in a pivotal manner. A link 100 has a first end 102 connected to a second end 84 of the locking member 80 in a pivotal manner and has a second end 104 thereof pivotally connected to the lever 90 intermediate the first end 92 and a second end 94 thereof. In operation, a rotation of the lever 90 in a first direction moves the first end 82 of the locking member 80 into the latched position and a rotation of the lever 90 in a second opposed direction moves the first end 82 of the locking member 80 into the unlatched position.

As it clearly shown in the drawings, the lever 90, of the presently preferred embodiment, rotates in a plane which is generally perpendicular to the rear surface of the at least one skid-steer loader attachment 2.

The locking assembly 72 further includes a spring means 110 caged intermediate the guide member 74 and the link 100 for urging the first end 82 of the locking member 80 for movement into the unlatched position.

There is a roller means 112 engageable with the mounting means 30 and attached to a pivotal connection of the locking member 80 with the link 100 for aiding the sliding movement of locking member 80.

Figure 2:
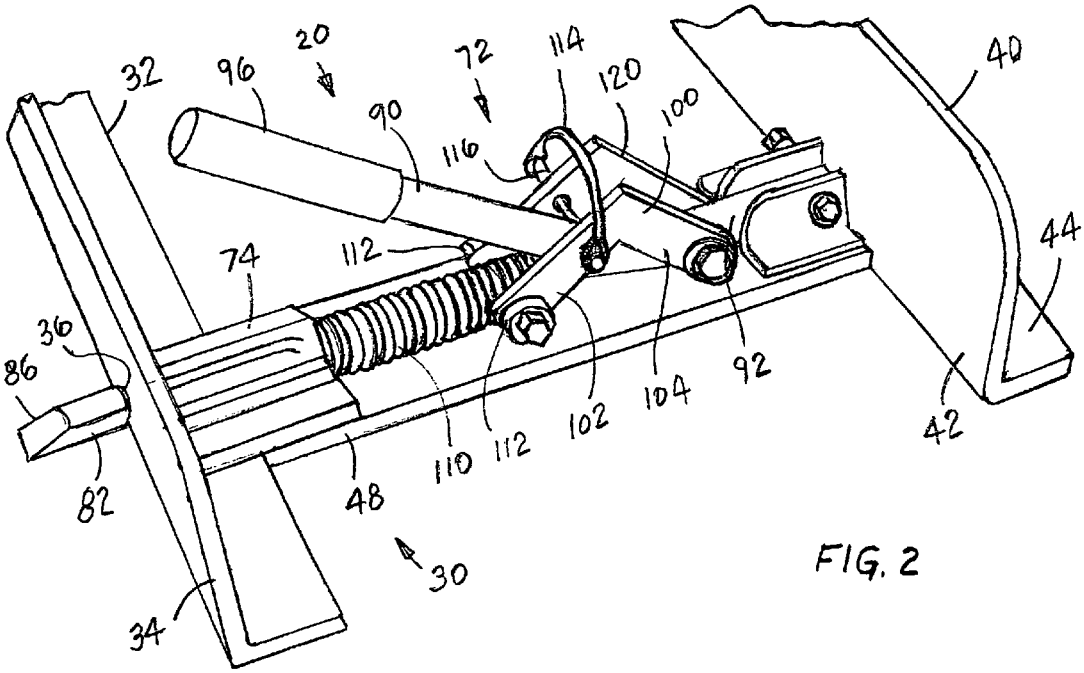
FIG. 2 is a partial perspective view of the adapter of FIG. 1 illustrating a locking assembly of the presently preferred embodiment of the invention.
Figure 3:
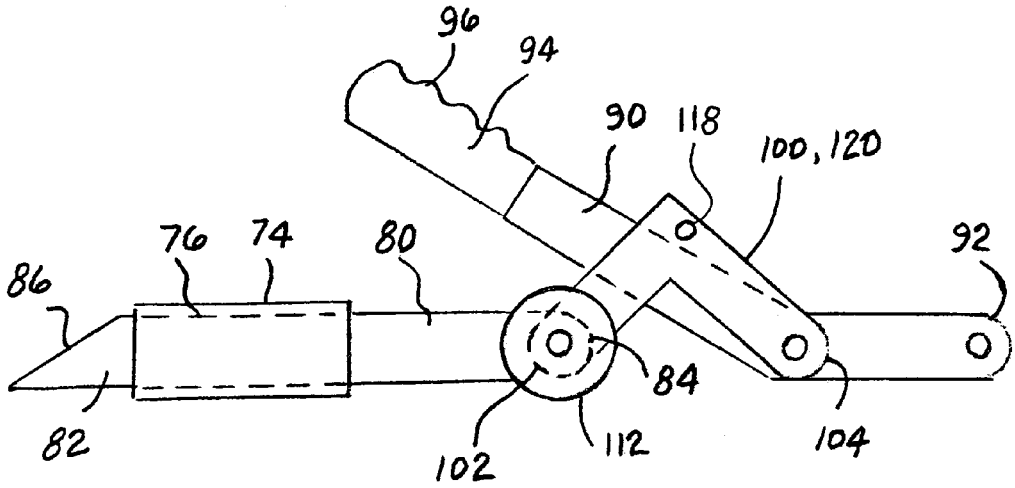
FIG. 3 is a schematic representation of the locking assembly of FIG. 2, illustrating such locking assembly disposed in a latched position.
Figure 4:
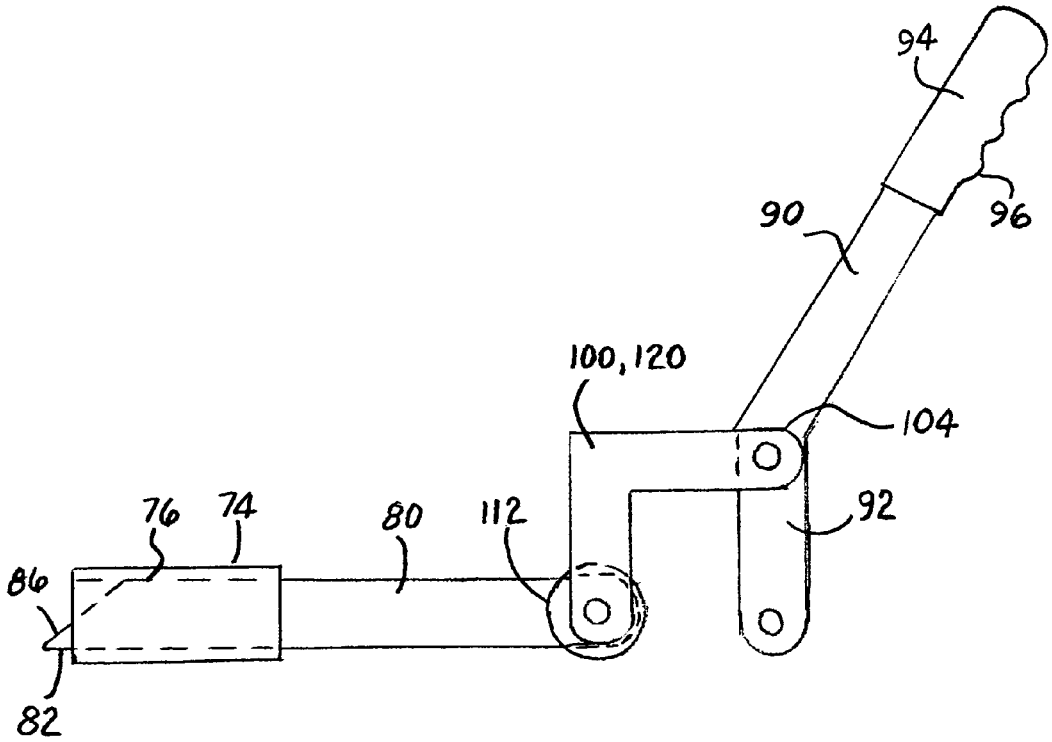
FIG. 4 is a schematic representation of the locking assembly of FIG. 2, illustrating such locking assembly disposed in an unlatched position.
Figure 5:
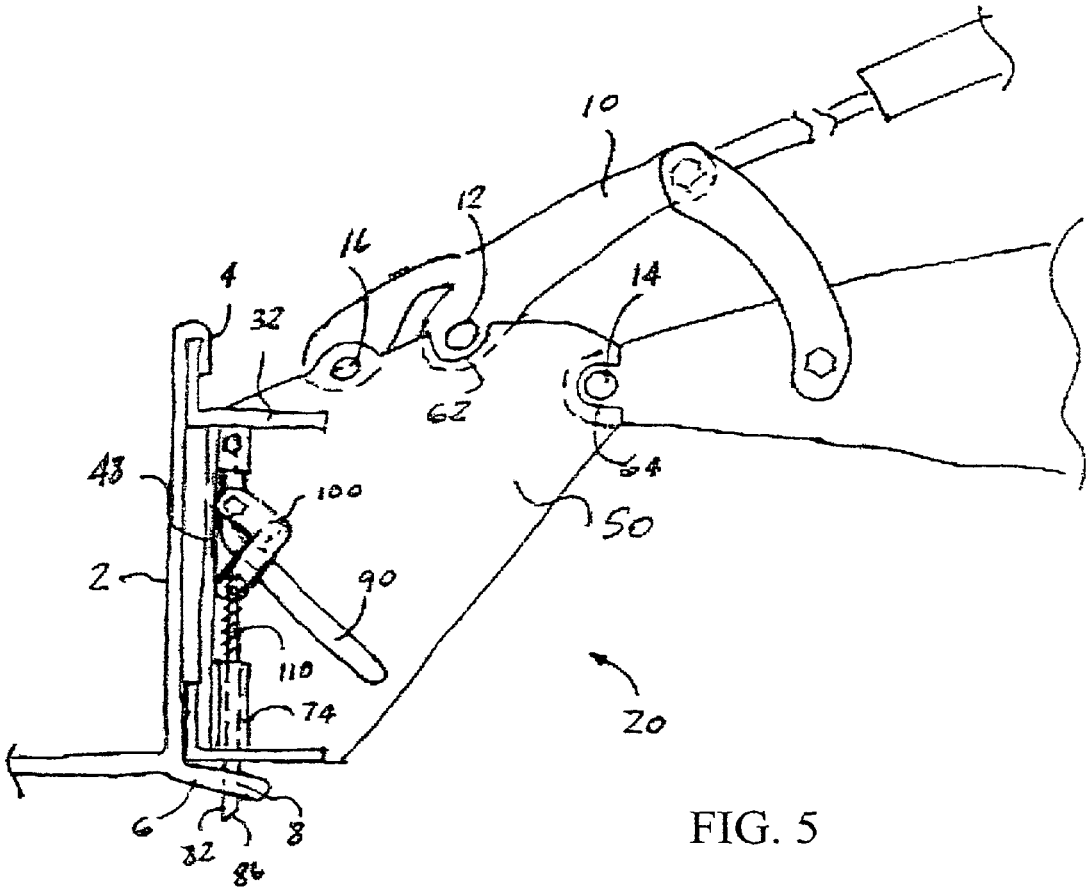
FIG. 5 is a side elevation view of the adapter of FIG. 1 coupled to the excavator arm and to a skid-steer loader attachment, both partially illustrated.

The arrangement of the locking assembly 72, as best shown in FIGS. 2-3 inherently incorporates an over center condition, formed by the position of the link 100 and by the position of the first end 92 of the lever 90 which is axially aligned with the locking member 80. Furthermore, as best shown in FIG. 5, the locking assembly 72 takes advantage of gravity in order to maintain the first end 82 of the locking member 80 in the latched position and to prevent an unintentional rotation of the lever 90 in the second direction. Additionally, the pivotal mounting of the first end 92 of the lever 90 provides a reactionary support during rotation of the lever 90 in the first direction, thus enabling the user to leverage the manual force applied at the grip means 94.

To further prevent an unintentional rotation of the lever 90 in the second direction and, more particularly, to prevent unintentional movement of the locking member 80 into the unlatched position, the locking assembly 72 may include an optional safety means 114. Such safety means 114 is preferably a safety pin 116. To accommodate such safety pin 116, the locking assembly 72 includes a second link 120 which is substantially identical to first link 100 and which is spaced therefrom by the width of lever 90. A pair of apertures 118 are provided wherein each aperture 118 is disposed in a respective link 100 and 120 and both apertures 118 are aligned together and safety pin 116 is passed through the pair of apertures 118 after the first rotation of the lever 90.

To further improve operation of the locking assembly 72, the lever 90 has a grip means 96 and the first end 82 of the locking member 80 includes a beveled surface 86.

When the mounting means 30 includes a pair of simple cross members 32 and 40, each locking assembly 72 is mounted on a brace member 48 which is rigidly attached to such pair of cross members 32 and 40.

It will be understood that the coupling means 60 provides for mounting the at least one skid-steer loader attachment 2 onto an excavator arm 10 in a manner which does not require modifications to existing skid-steer loader attachment 2 or existing excavator arms 10. The coupling means 60 further enables the use of existing procedures of mounting attachments onto the excavator arm 10.

It will be appreciated that the size of adapter 20 will be predetermined to fit a particular skid-steer loader model as a number of manufacturers currently manufacture such equipment.

Figure 6:
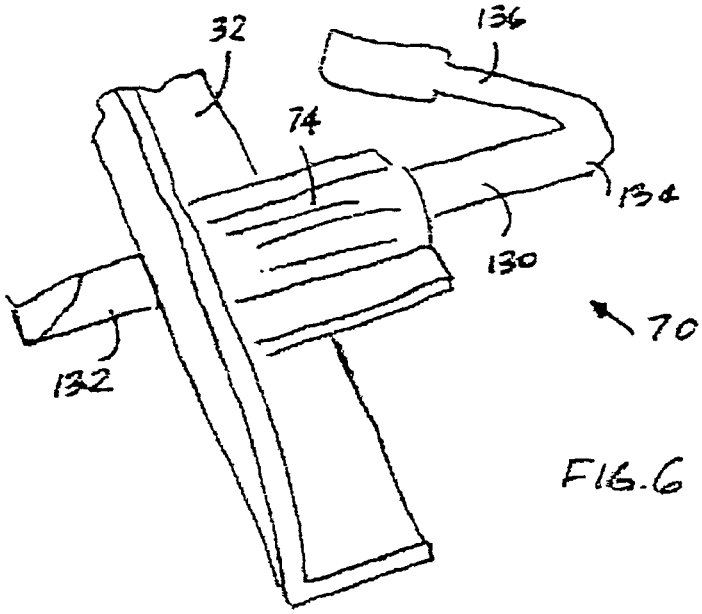
FIG. 6 is a partial perspective view of the adapter of FIG. 1, illustrating a locking arrangement according to one alternative embodiment of the invention.

Now in reference to FIG. 6 there is illustrated a first alternative embodiment of the locking means 70, which includes a simple elongated locking member 130 being slidingly movable within the guide member 74. The first end 132 of the locking member 130 operates identically to the first end 82 of the locking lever 80 described above. The second end 134 may be enlarged for retaining the locking member 130 in the latched position during use, and is preferably terminated with a lever 136 for aiding in selective movement of such locking member 130 between latched and unlatched positions. It will be appreciated that the lever 136 moves linearly for selectively engaging and releasing the lower edge 6 of such at least one skid-steer loader attachment 2.

Figure 7:
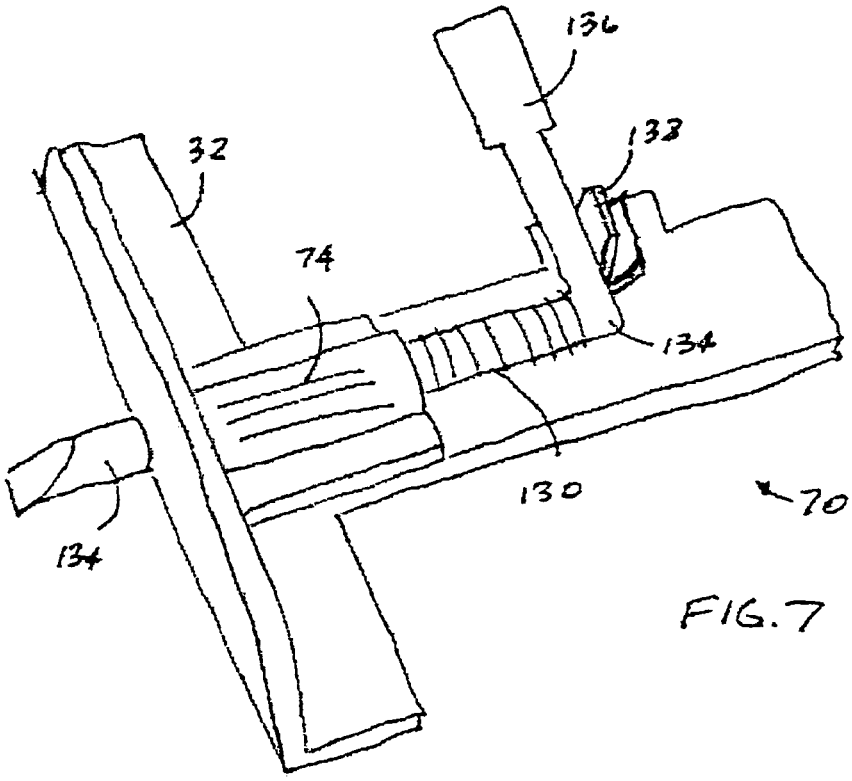
FIG. 7 is a partial perspective view of the adapter of FIG. 1, illustrating a locking arrangement according to another alternative embodiment of the invention.

FIG. 7 illustrates a second alternative embodiment of the locking means 70, which is an improvement of the locking means 70 of FIG. 6, wherein the lever 136 is first moved linearly to move the first end 132 into the latched position and then is rotated into a plane which is generally planar to the rear surface of the at least one skid-steer loader attachment 2 and wherein the locking means 70 is further provided with a stop means 138, for example, such as a simple bracket 138, for securely maintaining the lever 136 in such rotated position. A spring means 140, caged intermediate the guide member 74 and the lever 136, may be provided for urging the first end 132 of the locking member 130 for movement into the unlatched position when the lever 136 is disengaged from the stop means 138.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. An adapter for mounting at least one skid-steer loader attachment onto an excavator arm, said adapter comprising:

(a) a mounting means having a lower edge, an upper edge, a lip extending outwardly therefrom for lockingly receiving an upper lip of the at least one skid-steer loader attachment and a pair of plate like members disposed in a parallel spaced relationship with each other and rigidly attached to each of said lower and upper edges;

(b) a coupling means for coupling said mounting means onto a free end of the excavator arm in a semi-permanent manner, said coupling means including:

i. a first pair of aligned generally U-shaped notches each formed in a top edge of a respective one of said pair of plate like members for engagement with a first pair of stationary pin lock members extending outwardly from the excavator arm, ii. a second pair of aligned generally U-shaped notches each formed in a rear edge of said respective one of said pair of plate like members for engagement with a second pair of stationary pin lock members extending outwardly from the excavator arm, and iii. a pair of aligned apertures each formed adjacent a top edge of said respective one of said pair of plate like members for receiving a locking pin employed in combination with the excavator arm; and (c) a locking means coupled to said mounting means and operable for selectively engaging and releasing a lower edge of the at least one skid-steer loader attachment.

2. An adapter for mounting at least one skid-steer loader attachment onto an excavator arm, said adapter comprising:

(a) a mounting means having a lower edge, an upper edge and a lip extending outwardly therefrom for lockingly receiving an upper lip of the at least one skid-steer loader attachment;

(b) a coupling means for coupling said mounting means onto a free end of the excavator arm in a semi-permanent manner; and (c) a pair of manually operable locking assemblies mounted in spaced relationship adjacent side edges of said mounting means for selectively engaging and releasing a lower edge of the at least one skid-steer loader attachment, each one of said pair of locking assemblies including:

i. an elongated hollow guide member rigidly attached to said mounting means adjacent said lower edge thereof, wherein a longitudinal axis of said guide member is disposed perpendicular to said lower edge of said mounting means and wherein a hollow interior portion of said guide member is aligned with an aperture disposed within said lower edge of said mounting means, ii. an elongated locking member mounted for a sliding movement within said hollow interior portion of said guide member, said locking member having a first end movable away from said lower edge of said mounting member into a latched position for engagement with a predetermined portion of the lower edge of the at least one skid-steer loader attachment, said first end movable towards said lower edge of said mounting member into an unlatched position for releasing the lower edge of the at least one skid-steer loader attachment, iii. a lever having a first end thereof connected to said mounting means in a pivotal manner, iv. a first link having a first end connected to a second end of said locking member in a pivotal manner, said link having a second end thereof pivotally connected to said lever intermediate said first end and a second end thereof, whereby a rotation of said lever in a first direction moves said first end of said locking member into said latched position, and whereby a rotation of said lever in a second direction moves said first end of said locking member into said unlatched position, v. a second link substantially identical to said first link and spaced therefrom by a width of said lever, vi. a pair of apertures each disposed within a respective link and aligned together, and vii. a safety means includes a safety pin passed through said pair of apertures after said first rotation of said lever.

3. The adapter, according to claim 2, wherein said mounting means includes:

(a) a first generally L-shaped cross member forming said lower edge;

(b) a second generally L-shaped cross member forming said upper edge and said lip extending outwardly therefrom; and (c) a pair of plate like members disposed in a parallel spaced relationship with each other and rigidly attached to said first cross member and said second cross member, each of said pair of plate like members having a portion of said coupling means formed therein.

4. The adapter, according to claim 2, wherein said coupling means includes:

(a) a first pair of aligned generally U-shaped notches each formed in a top edge of a respective one of said pair of plate like members for engagement with a first pair of stationary pin lock members extending outwardly from the excavator arm;

(b) a second pair of aligned generally U-shaped notches each formed in a rear edge of said respective one of said pair of plate like members for engagement with a second pair of stationary pin lock members extending outwardly from the excavator arm; and (c) a pair of aligned apertures each formed adjacent a top edge of said respective one of said pair of plate like members for receiving a locking pin employed in combination with the excavator arm.

5. The adapter, according to claim 1, wherein said locking means includes a pair of manually operable locking assemblies mounted in spaced relationship adjacent side edges of said mounting means, each one of said pair of locking assemblies including:

(a) an elongated hollow guide member rigidly attached to said mounting means adjacent said lower edge thereof, wherein a longitudinal axis of said guide member is disposed perpendicular to said lower edge of said mounting means and wherein a hollow interior portion of said guide member is aligned with an aperture disposed within said lower edge of said mounting means;

(b) an elongated locking member mounted for a sliding movement within said hollow interior portion of said guide member, said locking member having a first end movable away from said lower edge of said mounting member into a latched position for engagement with a predetermined portion of the lower edge of the at least one skid-steer loader attachment, said first end movable towards said lower edge of said mounting member into an unlatched position for releasing the lower edge of the at least one skid-steer loader attachment;

(c) a lever having a first end thereof connected to said mounting means in a pivotal manner; and (d) a link having a first end connected to a second end of said locking member in a pivotal manner, said link having a second end thereof pivotally connected to said lever intermediate said first end and a second end thereof, whereby a rotation of said lever in a first direction moves said first end of said locking member into said latched position, and whereby a rotation of said lever in a second direction moves said first end of said locking member into said unlatched position.

6. The adapter, according to claim 5, wherein said locking means further includes a spring means caged intermediate said guide member and said link for urging said first end of said locking member for movement into said unlatched position.

7. The adapter, according to claim 5, wherein said locking assembly further includes a roller means engageable with said mounting means and attached to a pivotal connection of said locking member with said link for aiding said sliding movement of said locking member.

8. The adapter, according to claim 5, wherein said locking assembly further includes a safety means for preventing said rotation of said lever in said second direction.

9. The adapter, according to claim 8, wherein said locking assembly includes a second link substantially identical to said first link and spaced therefrom by a width of said lever and a pair of apertures each disposed within a respective link and aligned together and wherein said safety means includes a safety pin passed through said pair of apertures after said first rotation of said lever.

10. The adapter, according to claim 5, wherein said lever includes a grip means.

11. The adapter, according to claim 5, wherein said first end of said locking member is beveled.

12. An adapter for mounting at least one skid-steer loader attachment onto an excavator arm, said adapter comprising:

(a) a mounting means having a lower edge, an upper edge and a lip extending outwardly therefrom, said lip lockingly receiving an upper lip of the at least one skid-steer loader attachment, said mounting means including:

i. a first generally L-shaped cross member forming said lower edge, ii. a second generally L-shaped cross member forming said upper edge and said lip extending outwardly therefrom, and iii. a pair of plate like members disposed in a parallel spaced relationship with each other and rigidly attached to said first cross member and said second cross member, each of said pair of plate like members having a portion of said coupling means formed therein;

(b) a coupling means for coupling said mounting means onto a free end of the excavator arm in a semi-permanent manner, said coupling means including:

i. a first pair of aligned generally U-shaped notches each formed in a top edge of a respective one of said pair of plate like members for engagement with a first pair of stationary pin lock members extending outwardly from the excavator arm, ii. a second pair of aligned generally U-shaped notches each formed in a rear edge of said respective one of said pair of plate like members for engagement with a second pair of stationary pin lock members extending outwardly from the excavator arm, and iii. a pair of aligned apertures each formed adjacent a top edge of said respective one of said pair of plate like members for receiving a locking pin employed in combination with the excavator arm; and (c) a pair of manually operable locking assemblies mounted in spaced relationship adjacent side edges of said mounting means for selectively engaging and releasing a lower edge of the at least one skid-steer loader attachment, each one of said pair of locking assemblies including:

i. an elongated hollow guide member rigidly attached to said mounting means adjacent said lower edge thereof, wherein a longitudinal axis of said guide member is disposed perpendicular to said lower edge of said mounting means and wherein a hollow interior portion of said guide member is aligned with an aperture disposed within said lower edge of said mounting means, ii. an elongated locking member mounted for a sliding movement within said hollow interior portion of said guide member, said locking member having a first end movable away from said lower edge of said mounting member into a latched position for engagement with a predetermined portion of the lower edge of the at least one skid-steer loader attachment, said first end movable towards said lower edge of said mounting member into an unlatched position for releasing the lower edge of the at least one skid-steer loader attachment, iii. a lever having a first end thereof connected to said mounting means in a pivotal manner, iv. a link having a first end connected to a second end of said locking member in a pivotal manner, said link having a second end thereof pivotally connected to said lever intermediate said first end and a second end thereof, whereby a rotation of said lever in a first direction moves said first end of said locking member into said latched position, and whereby a rotation of said lever in a second direction moves said first end of said locking member into said unlatched position, and v. a spring means caged intermediate said guide member and said link for urging said first end of said locking member for movement into said unlatched position.

* * * * *